United States Patent [19]

Wells et al.

[11] 4,230,946

[45] Oct. 28, 1980

[54] CRYOGENIC COLLIMATOR APPARATUS AND METHOD

[75] Inventors: Gregory J. Wells, Murray; Kent J. Voorhees, Bountiful, both of Utah

[73] Assignee: University of Utah, Salt Lake City, Utah

[21] Appl. No.: 21,417

[22] Filed: Mar. 19, 1979

[51] Int. Cl.[3] ..... H01J 27/00

[52] U.S. Cl. ..... 250/425; 250/281; 250/427

[58] Field of Search ..... 250/425, 427, 281, 282

[56] References Cited

U.S. PATENT DOCUMENTS

| | | | |
|---|---|---|---|
| 2,848,620 | 8/1958 | Backus | 250/425 |
| 3,660,655 | 5/1972 | Wardell | 250/427 |
| 4,039,828 | 8/1977 | Pokar | 250/427 |

*Primary Examiner*—Harold A. Dixon

[57] ABSTRACT

A cryogenic collimator apparatus and method for collimating pyrolysis fragments produced by a pyrolysis unit. The apparatus includes a cryogenic plate having an aperture therein, the plate being adapted to be interposed between the pyrolysis unit and an ionization center so that the aperture is in a direct line between the pyrolysis unit and the ionization center. The method includes using the cryogenic plate for trapping pyrolysis fragments not passing through the aperture directly from the pyrolysis unit.

7 Claims, 2 Drawing Figures

CRYOGENIC COLLIMATOR APPARATUS AND METHOD

BACKGROUND

1. Field of the Invention

This invention relates to mass spectrometers and, more particularly, to a cryogenic collimator for collimating pyrolysis fragments prior to ionizing the pyrolysis fragments for analysis in the mass spectrometer.

2. The Prior Art

Mass spectrometers are well known in the art and are used to analyze ionized pyrolysis fragments produced upon pyrolysis of a sample. The ionization step in the foregoing procedure occurs in an ionization center located in an evacuated chamber. However, it has been known that the pyrolysis step generates gaseous products and causes a pressure rise within the evacuated chamber of several orders of magnitude of pressure increase. Accordingly, one researcher has included a cryogenic plate adjacent the ionization center opposite the pyrolysis unit. The cryogenic plate acts as a trap for pyrolysis fragments thereby removing those pyrolysis fragments from contributing to a pressure increase in the evacuated chamber.

In one prior art device, pyrolysis occurs in an enlarged, evacuated vessel having a small outlet directed toward the ionization center. Pyrolysis of a sample inside the vessel results in a substantial pressure increase so that the pyrolysis products are directed as a jet into the ionization center. However, it has been recently discovered that secondary collisions occur between pyrolysis fragments and that these secondary conditions result in secondary reactions which produce compounds that were not present in the original sample. These spurious or secondary compounds interfere with the accuracy of the reading obtained from the mass spectrometer.

In view of the foregoing, it would be an advancement in the art to provide an apparatus and method for reducing the number of secondary collisions in pyrolysis fragments from a pyrolyzed sample. It would also be an advancement in the art to provide an apparatus and method for collimating pyrolysis fragments directly from the pyrolyzed sample. Such an invention is disclosed and claimed herein.

BRIEF SUMMARY AND OBJECTS OF THE INVENTION

The present invention relates to a novel cryogenic collimator apparatus and method for collimating pyrolysis fragments from a pyrolyzed sample toward an ionization center for a mass spectrometer. The pyrolysis fragments are collimated by placing an aperture in a cryogenic plate on a line between the pyrolysis unit and the ionization center. The body of the cryogenic plate surrounding the aperture traps pyrolysis fragments impinging thereon while the aperture allows those pyrolysis fragments produced in the pyrolysis unit and expelled outwardly in a line of sight toward the ionization center to pass through the aperture thereby avoiding secondary collisions between the pyrolysis fragments and other pyrolysis fragments now trapped by the cryogenic plate.

It is, therefore, a primary object of this invention to provide improvements in mass spectrometers.

Another object of this invention is to provide an improved method for reducing secondary collisions among pyrolysis fragments.

Another object of this invention is to provide a cryogenic collimator apparatus for a pyrolysis unit in a mass spectrometer.

These and other objects and features of the present invention will become more fully apparent from the following description and appended claims taken in conjunction with the accompanying drawing.

DETAILED DESCRIPTION OF THE PREFERRED EMBODIMENTS

Figure 1:
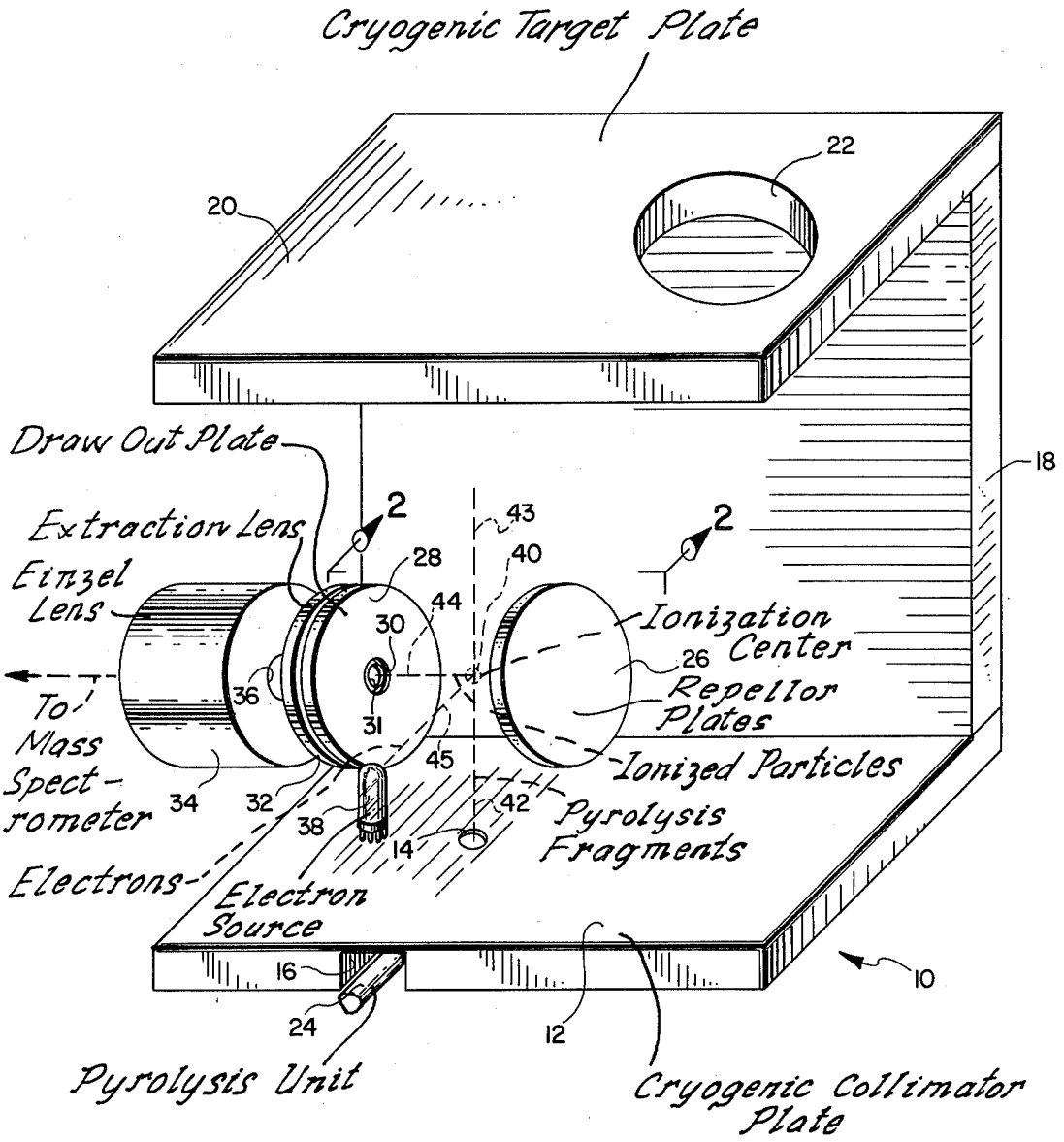
FIG. 1 is a schematic, perspective view of a cryogenic collimating apparatus of this invention shown with the environment of an ionization center for a mass spectrometer.

The invention is best understood by reference to the drawing wherein like parts are designated with like numerals throughout.

Referring now to the drawing, the cryogenic collimating apparatus of this invention is shown generally at 10 and includes a cryogenic collimator plate 12 having an aperture 14. Aperture 14 communicates with a slot 16 on the bottom side of cryogenic collimator plate 12. A cryogenic target plate 20 is superimposed over cryogenic collimator plate 12 by means of cryogenic backing plate 18. An opening 22 in cryogenic target plate 20 serves as a support for a suitable cryogenic apparatus (not shown) such as a container of liquid nitrogen, or the like. Cryogenic collimator plate 12, cryogenic target plate 20 and cryogenic backing plate 18 are all fabricated from a suitable conductive metal such as aluminum or the like and are mounted so as to be in intimate thermal contact. The intimate thermal contact permits the cryogenic apparatus (not shown) inserted into opening 22 to suitably cool cryogenic collimator plate 12 for the purposes of this invention.

Located between cryogenic target plate 20 and cryogenic collimating plate 12 is an ionization center 40 and also between a repellor plate 26 and a draw out plate 28. Ionization center 40 is a conventional ionization center wherein a stream of electrons 45 are directed into a stream of pyrolysis fragments 42 to produce a stream of ionized particles 44. Electrons for electron stream 45 are provided by an electron source 38. Electron source 38 is configurated as a conventional electron source and may be fabricated as a conventional electron gun having a heated, rhenium wire.

Draw out plate 28 includes an aperture 30 and is backed by an extraction lens 32 having an aperture 31 at the tip and a conical member 33. Conical member 33 is nested within a recess on the reverse bore of aperture 30. An Einzel lens 34 is mounted behind extraction lens 32 and includes an axial bore 36. Draw out plate 28, extraction lens 32 and repellor plate 26 are each suitably charged to provide the electromagnetic field for the ionized particles 44 to direct the same through apertures 30 and 31. Einzel lens 34 is a conventional device well known in the art and is illustrated schematically herein to assist in understanding the invention.

Figure 2:
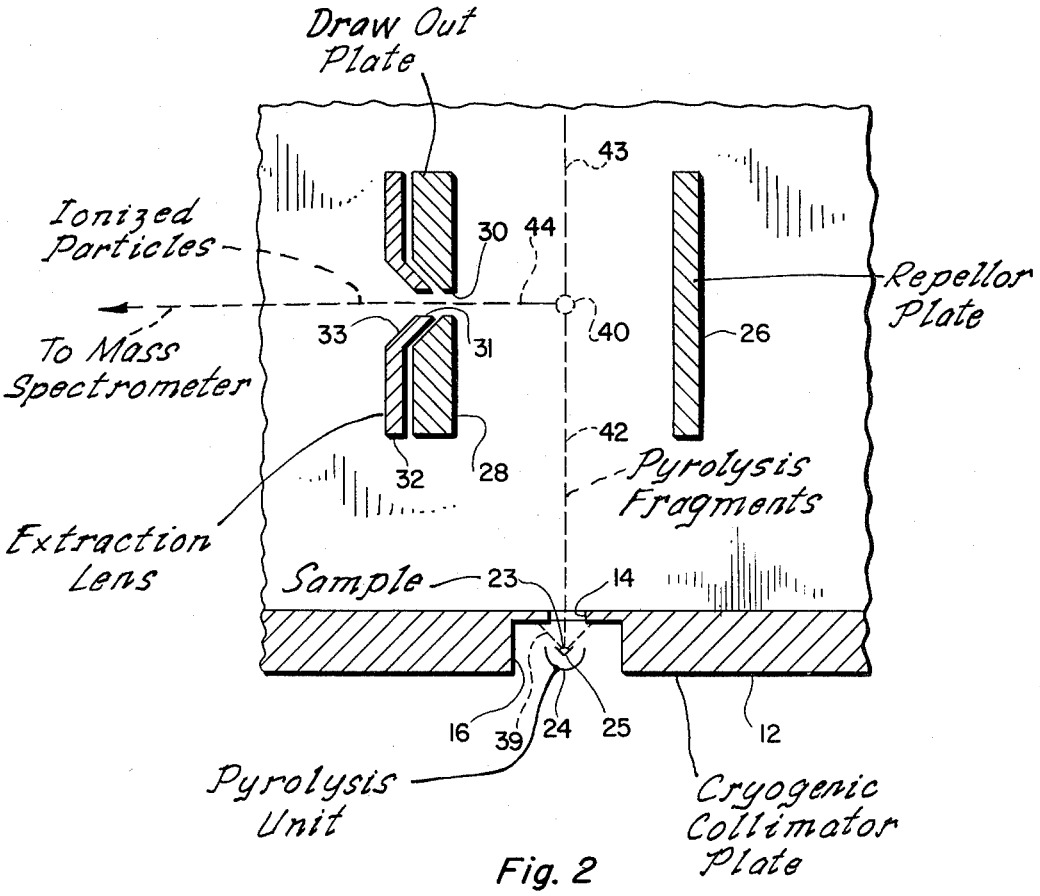
FIG. 2 is a cross section taken along lines 2—2 of FIG. 1.

With particular reference to FIG. 2, pyrolysis unit 24 is adjustably inserted in slot 16 and includes a pyrolyzer filament 25 mounted therein. Pyrolysis unit 24 is conventional and is only illustrated schematically herein for the purpose of more clearly setting forth the invention claimed. Pyrolyzer filament 25 is configurated with a trough-like shape to hold a body of sample 23. In operation, sample 23 is pyrolyzed by rapidly heating pyrolyzer filament 25 thereby producing pyrolysis fragments that are emitted in a wide dispersal pattern as illustrated schematically at broken lines 39. Pyrolysis fragments also pass through aperture 14 as pyrolysis fragments 42 into ionization center 40. Pyrolysis fragments 39 not passing through aperture 14 are frozen to the surface of cryogenic collimator plate 12.

In ionization center 40, stream of electrons 45 strike pyrolysis fragments 42 ionizing the same. Pyrolysis fragments that are not ionized by electron stream 45 continue upwardly as pyrolysis fragments 43 and impinge on the underside of cryogenic target plate 20 where they are frozen to the surface. Repellor plate 26 is suitably charged to repel the ionized pyrolysis fragments 44 while draw out plate 28 and extraction lens 32 have an opposite charge to attract the same through apertures 30 and 31, respectively. Einzel lens 34 directs the ionized particle stream 44 into the mass spectrometer (not shown).

Surprisingly, the present invention has been found to be very successful in collimating pyrolysis fragments 42 thereby substantially eliminating the tendency for secondary collisions between the pyrolysis fragments 42 which secondary collisions would tend to create secondary reaction products which were not originally present in sample 23. Accordingly, with the apparatus and method of this invention it is possible to obtain pyrolysis fragments directly from the pyrolyzed sample 23 to provide a more accurate indication as to the constituents of sample 23. In addition to collimating pyrolysis fragments 42, cryogenic collimator plate 12 also minimizes surface absorption of pyrolysis fragments 39 on the equipment of this apparatus such as repellor plate 26 and draw out plate 28.

Pyrolysis unit 24 is shown recessed within groove 16. However, pyrolysis unit 24 may be mounted to accommodate being raised or lowered relative to aperture 14 to meet the requirements for analysis of the particular sample 23. In either event, the novel cryogenic collimator apparatus of this invention as provided by cryogenic collimator plate 12 with aperture 14 therein and provides a novel apparatus and method for collimating pyrolysis fragments 42.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed and desired to be secured by a United States Letters Patent is:

1. An improved ion source for a mass spectrometer wherein pyrolysis fragments from a pyrolysis unit are directed into an ionization center for ionization and the ionized particles of pyrolysis fragments are directed into the mass spectrometer for analysis, the improvement comprising a cryogenic means having an aperture therethrough, the cryogenic means being adapted to be placed adjacent the pyrolysis unit with the aperture in a direct line between the pyrolysis unit and the ionization center, the cryogenic means thereby holding pyrolysis fragments impinging thereon with the aperture collimating pyrolysis fragments from the pyrolysis unit into the ionization center.

2. The improvement of claim 1 wherein the aperture comprises a recess adjacent the pyrolysis unit, the recess accommodating adjustably orienting the pyrolysis unit relative to the aperture in the cryogenic means.

3. The improvement of claim 1 wherein the cryogenic means comprises a metal plate in thermal contact with a cryogenic source.

4. A collimator apparatus for collimating pyrolysis fragments between a pyrolysis unit and an ionization center comprising:

cryogenic means adapted to be interposed between the pyrolysis unit and the ionization center, the cryogenic means having an aperture for placement in a direct line between the pyrolysis unit and the ionization center, the aperture collimating pyrolysis fragments passing therethrough and the cryogenic means holding pyrolysis fragments impinging thereon.

5. The collimator apparatus defined in claim 4 wherein the cryogenic means comprises a metal plate in thermal contact with a cryogenic source.

6. The collimator apparatus defined in claim 5 wherein the aperture comprises a recess in the plate adjacent the pyrolysis unit, the recess being formed as a diametrally enlarged slot adjacent the pyrolysis unit.

7. A method for collimating pyrolysis fragments produced by a pyrolysis unit comprising:

obtaining a cryogenic means, the cryogenic means including a cryogenic source;

forming an aperture in the cryogenic means;

placing the cryogenic means adjacent the pyrolysis unit with the aperture in juxtaposition with the pyrolysis unit;

emitting pyrolysis fragments from the pyrolysis unit by heating a sample in the pyrolysis unit; and collimating pyrolysis fragments emitted from the pyrolysis unit by allowing a portion of the pyrolysis fragments to pass through the aperture while capturing the remainder of the pyrolysis fragments impinging on the cryogenic means.

* * * * *